United States Patent [19]

Kelley et al.

[11] Patent Number: 4,854,913

[45] Date of Patent: Aug. 8, 1989

[54] TOY CRIB APPARATUS

[75] Inventors: William J. Kelley, Torrance; Daniel G. Hurtienne, Carson, both of Calif.

[73] Assignee: Mattel, Inc., Hawthorne, Calif.

[21] Appl. No.: 220,199

[22] Filed: Jul. 18, 1988

[51] Int. Cl.[4] ..... A63H 5/00; A63H 3/52

[52] U.S. Cl. ..... 446/397; 446/482; 446/227; 446/489; 5/93 R

[58] Field of Search ..... 446/482, 227, 489, 490, 446/479, 397, 404, 408, 418, 243, 265, 268; 5/93 R, 95, 101, 108, 109

[56] References Cited

U.S. PATENT DOCUMENTS

| | | | |
|---|---|---|---|
| 602,215 | 4/1898 | Foster | 446/227 |
| 3,713,652 | 1/1973 | Rakestraw | 446/482 X |
| 3,988,856 | 11/1976 | Doppelt . | |
| 4,285,159 | 8/1981 | Bass et al. | 446/227 |
| 4,664,640 | 5/1987 | Shindo et al. | 446/227 |
| 4,670,820 | 6/1987 | Eddins et al. | 446/227 X |
| 4,708,689 | 11/1987 | Hou | 446/301 |

FOREIGN PATENT DOCUMENTS

| | | | |
|---|---|---|---|
| 298766 | 7/1956 | Switzerland | 446/397 |

*Primary Examiner*—Mickey Yu

*Attorney, Agent, or Firm*—Melvin A. Klein; Ronald M. Goldman

[57] ABSTRACT

Toy crib apparatus which includes a crib housing having at least one hollow rail member supporting a sliding toy member and one hollow wall member. A drive mechanism housed by the hollow wall member is connected to a flexible rod member that extends in a path from the hollow wall member along the hollow rail member. The flexible rod member is connected to a drive member for engaging the toy member for imparting sliding movement to a toy member. At the same time the drive mechanism provides a rocking movement to an accessory positioned adjacent the crib housing and movement to a graphic display observed through an opening formed in the hollow wall member.

7 Claims, 3 Drawing Sheets

TOY CRIB APPARATUS

BACKGROUND OF THE INVENTION

1. Field of the Invention

The invention relates to a toy crib apparatus to be used as a play thing for small children, and more particularly to a toy member sliding on a crib rail, a toy rocking member positioned adjacent the crib and a moving graphic display occurring simultaneously.

2. Description of the Prior Art

U.S. Pat. No. 3,988,856 shows a toy musical cradle with integral musical instrument.

U.S. Pat. No. 4,285,159 shows a direction reversing crib toy for moving back and forth along a crib rail.

U.S. Pat. No. 4,670,820 shows an animated night light and music box combination.

U.S. Pat. No. 4,708,689 shows a toy music rocking chair.

SUMMARY OF THE INVENTION

According to one aspect of in the present invention, a toy crib apparatus is disclosed which provides a crib housing, a toy member which is slidable along a hollow rail member of the crib housing. The crib housing has a hollow wall member to house a drive mechanism. The drive mechanism includes a crank member connected to a flexible rod member which extends in a path from the hollow wall member along the hollow rail member. The flexible rod member is connected to a drive member received in a channel formed in the hollow rail member for engaging the toy member and imparting a reciprocating sliding movement to the toy member along the hollow rail member of the crib.

Another aspect of the invention is that the drive mechanism includes a flange member supported for rotating movement in the hollow wall member which flange member has a graphic display formed thereon such that the graphic display is visible through a slot opening formed in the hollow wall member for amusement to children.

Another aspect of the invention is that the drive mechanism includes a star cam member which engages a follower lever member that is pivoted on a pivot axis for imparting an oscillating movement thereto. The follower lever member extends to a position adjacent the crib for engagement with a toy rocking member such as a rocking horse or rocking chair to the delight of children.

Another aspect of the invention is that the drive mechanism is powered by a wind up music box which is supported by the housing of the crib to play music while all of the aforementioned activities are happening.

DETAILED DESCRIPTION OF THE PREFERRED EMBODIMENTS

Figure 1:
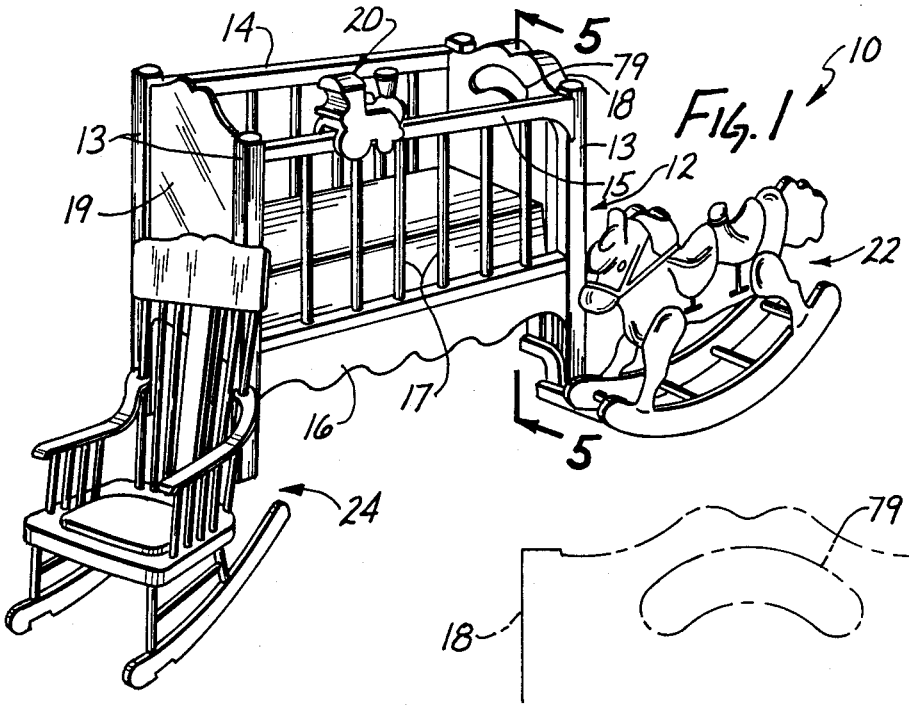
FIG. 1 is a perspective view of the toy crib apparatus.
Figure 2:
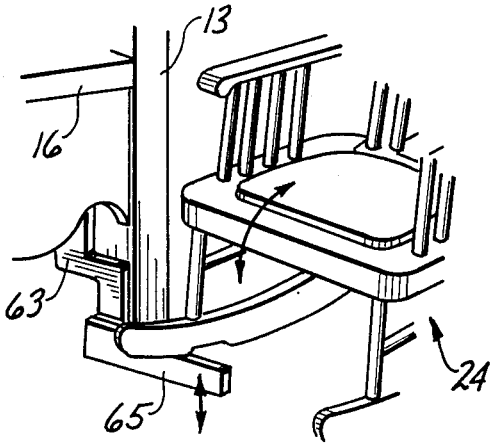
FIG. 2 is an enlarged partial view of the crib housing and rocking chair according to one embodiment of the invention.

Referring now to FIG. 1 there is shown a crib toy apparatus generally designated 10 which includes a crib housing 12, having post members 13, upper rail members 14 and 15, a base support 16, bar members 17, and end wall members 18 and 19. Positioned on rail member 15 is a toy member 20 having any desirable shape such as that of a locomotive as shown. Toy member 20 moves slidably along the rail member 15 first in one direction and then in the opposite direction in reciprocating fashion. At the same time, a rocking horse 22 is positioned adjacent to the crib housing and is engaged to impart a rocking movement to the rocking horse. Alternatively, instead of a rocking horse, a rocking chair 24 (FIG. 2) can be used in place of the rocking horse.

Figure 6:
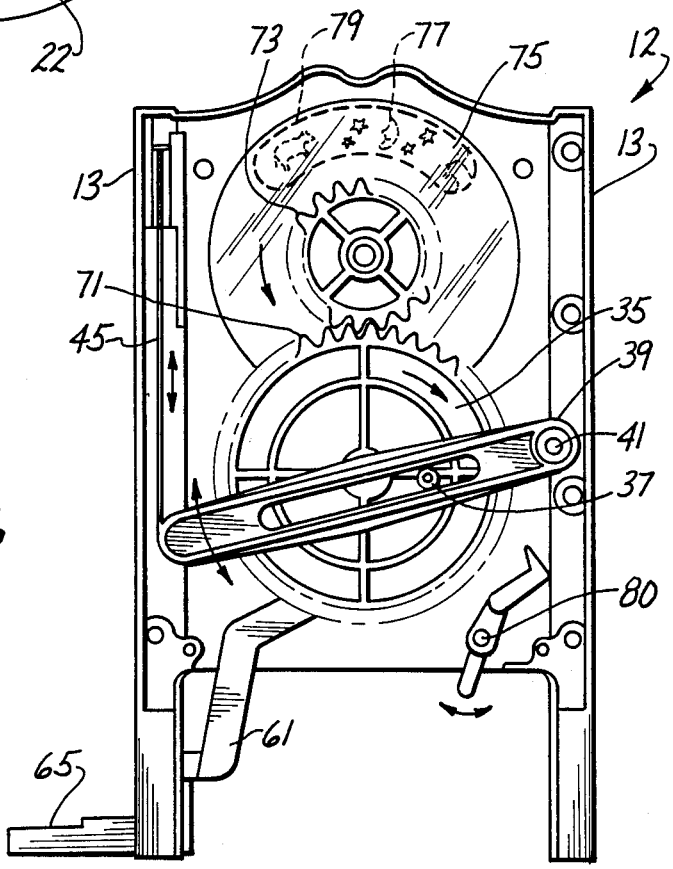
FIG. 6 is an end view of the toy crib apparatus illustrating details of the drive mechanism.
Figure 8:
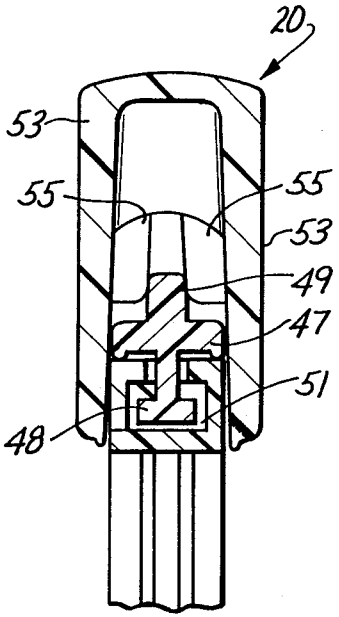
FIG. 8 is a sectional view taken along lines 8—8 in FIG. 7.
Figure 7:
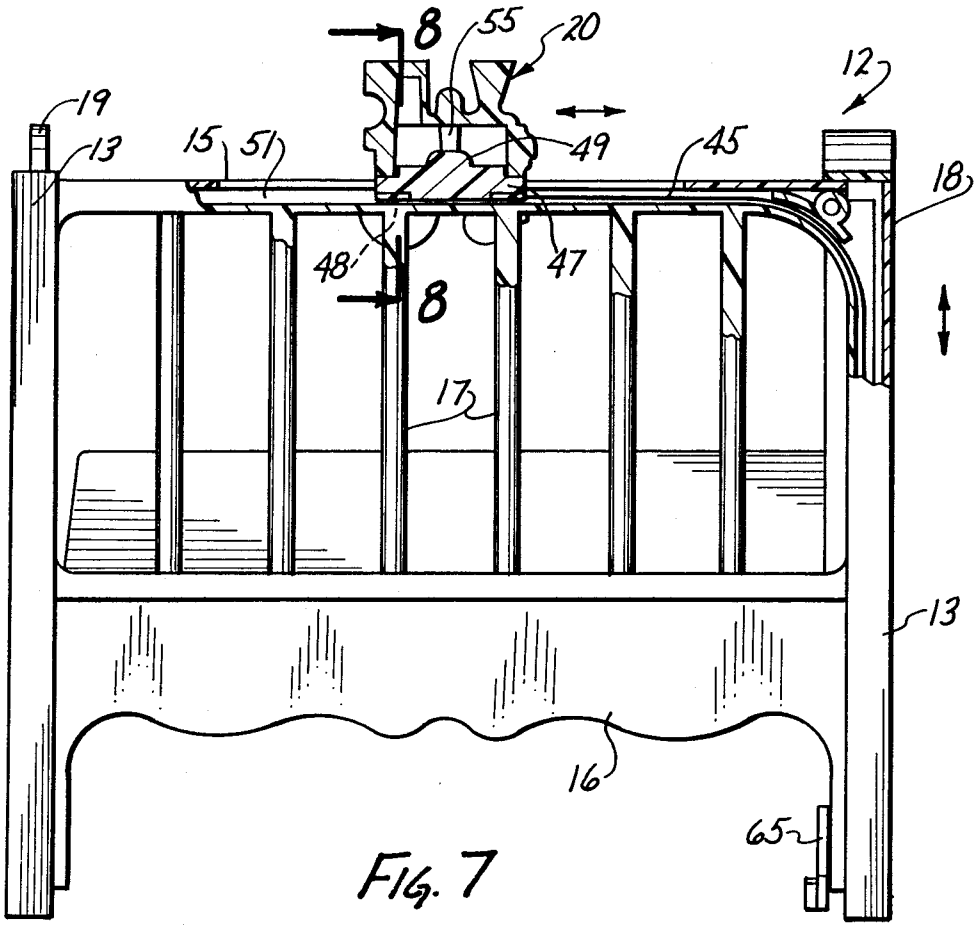
FIG. 7 is a side view of the crib housing with certain parts in section.

Referring to FIGS. 4–8 there is shown the details of a drive mechanism 28 for imparting the sliding reciprocating movement to the toy member 20 and either to the rocking horse 22 or to the rocking chair 24. The rail member 15 and wall member 18 are hollow to house the drive mechanism. A wind up music box 30 is supported at the bottom of the crib 12 to provide a power source and pleasant music during play operation. The music box 30 has a shaft member 32 extending into the hollow wall member 18. Press fitted onto the shaft member 32 is a star cam member 34 and, integrally formed with the star cam member 34 is a crank gear member 35 such that upon rotation of the shaft member 32 rotation is imparted to the star cam member 34 and the crank gear member 35. Crank gear member 35 is formed with a crank pin member 37. A drive lever member 39 is pivotally mounted on wall member 18 on an axis through a pin 41 (FIG. 6). The drive lever member has a slot 43 formed therein to receive crank pin member 37. It will be appreciated that upon rotation of the shaft member 32 that a cranking movement is imparted to the drive lever member 39 for a purpose to be described hereinafter.

At one end the drive lever member 39 is connected to a flexible rod member 45 which extends along the path extending from the hollow wall member 18 into the hollow rail member 15. At the opposite end of the flexible rod member 45 is a T-shaped member 47 having a protrusion 49 extending therefrom to receive toy member 20. The base 48 of the T-shaped member 47 is received within a channel 51 formed in the hollow rail member 15. Toy member 20 has side walls 53 extending over hollow rail member 15 and has support members 55 adapted to receive protrusion 49 to enable a sliding reciprocating movement to be imparted to the toy member 20 through the movement of flexible rod member 45 and crank gear member 35.

Figure 4:
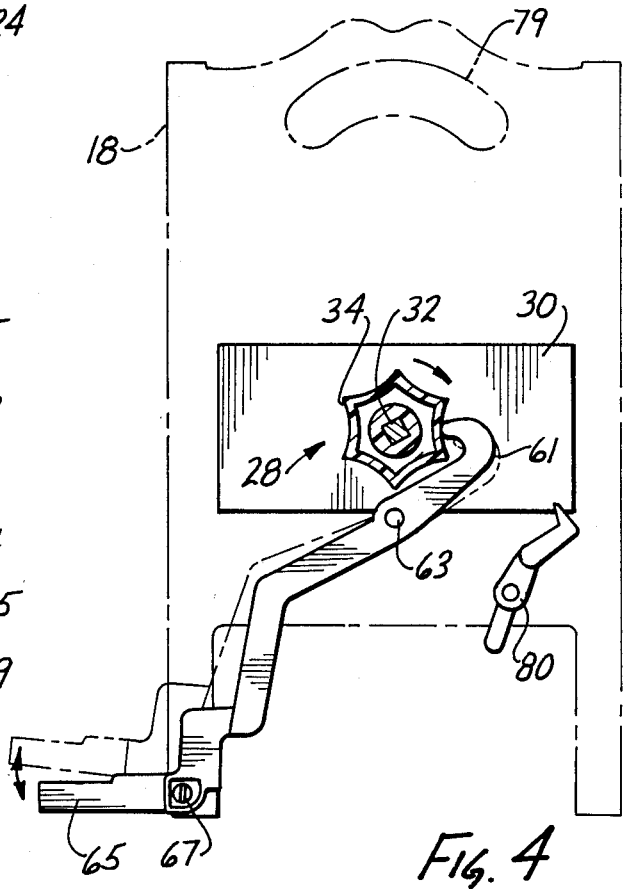
FIG. 4 is an end view of the crib toy apparatus illustrating certain details of the drive mechanism.
Figure 5:
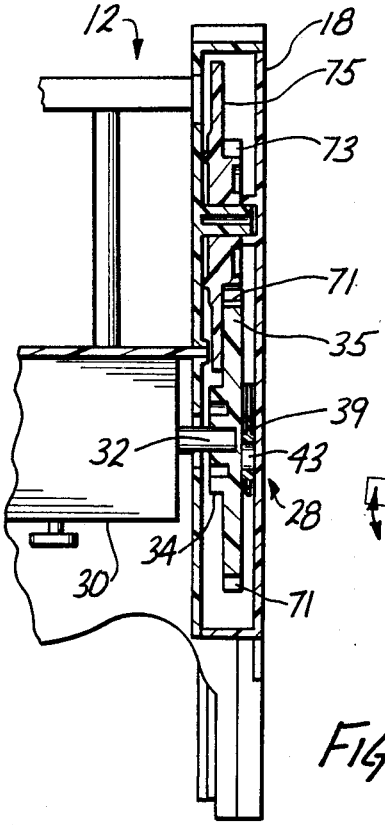
FIG. 5 is a partial side sectional view of the hollow end wall and drive mechanism of the apparatus taken along lines 5—5 in FIG. 1.
Figure 3:
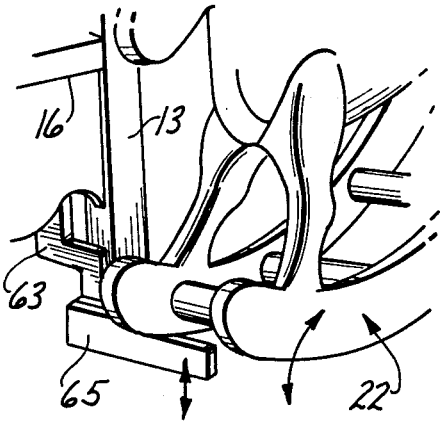
FIG. 3 is an enlarged partial view of the crib and a rocking horse according to a second embodiment of the invention.

Referring in particular to FIG. 4, it will be noted that star cam member 34 engages a follower lever member 61 which is pivotally mounted on wall member 18 on an axis through pin member 63. Follower lever member 61 has an L-shaped extension 65 at one end thereof which oscillates up and down causing a rocking action to be imparted to either the rocking horse 22 or rocking chair 24 that are positioned adjacent to the crib housing in engagement with extension 65. It will be appreciated that the L-shaped extension 65 has a pin 67 to enable the L-shaped extension 65 to be pivoted out of the way of the rocking chair or rocking horse when not in use.

Referring now in particular to FIG. 6 it will be noted that crank gear member 35 has gear teeth 71 that engage gear teeth 73 formed in a flange member 75 to cause rotation of the flange member with the crank gear member 35. It will be further noted that the flange member 75 has a graphic display 77 formed thereon and that the graphic display 77 can be viewed through the slot opening 79 formed in hollow wall member 18 to the amusement of children. A pivotable pawl 80 (FIG. 4) is used to stop the drive mechanism by engagement with crank gear member 35.

It will now be appreciated that by the above described toy crib apparatus, various activities may be performed simultaneously including the sliding reciprocal movement of a toy member on a crib rail, a rocking toy member positioned adjacent to the crib housing and a moving graphic display all operating together with music for the amusement of children.

While the invention has been described in detail and with reference to specific embodiments thereof, it will be apparent to one skilled in the art that various changes and modifications can be made thereon without departing from the spirit and scope thereof.

We claim:

1. Toy crib apparatus comprising, a housing having a crib interior, at least one hollow rail member defining an internal channel, and one hollow wall member;

a moveable toy member slidably supported on said hollow rail member;

slide means including a sliding member coupled to said moveable toy member and guided by said internal channel in said hollow rail member and a flexible rod member coupled to said sliding member and extending in a path along said hollow rail member and said hollow wall member, and drive means including a crank drive member housed by said hollow wall member and connected to said flexible rod member to impart sliding reciprocal movement to said flexible rod member, said sliding member and said toy member.

2. Apparatus according to claim 1 wherein said drive means includes a wind up music box having a shaft member extending into said hollow wall member and coupled to said crank drive member.

3. Apparatus according to claim 1 wherein said hollow wall member defines a slot opening and wherein said drive means includes a driven flange member mounted for rotatable movement having a display surface and a graphic pattern supported thereon, said flange member supported with respect to said slot opening to enable said graphic display to be viewed from within said crib interior during rotation of the flange member.

4. Apparatus according to claim 1 wherein said drive means includes a cam member and an engaging follower lever member, said follower lever member being pivotally supported by said hollow wall member to impart rocking movement to a toy accessory positioned adjacent said housing in engagement with said follower lever member.

5. Apparatus according to claim 4 further including a toy accessory configured as a rocking horse.

6. Apparatus according to claim 4 further including a toy accessory configured as a rocking chair.

7. Toy crib apparatus comprising, a housing having at least one hollow rail member defining a channel, and one hollow wall member;

a moveable toy member slidably supported on said hollow rail member;

a sliding member being guided by said channel in said hollow rail member and being in engagement with said moveable toy member to impart sliding movement thereto when said sliding member is moved;

a flexible rod member connected to said sliding member and extending in a path along said hollow rail member and said hollow wall member, and a drive mechanism including a shaft member extending into said hollow wall member, a star cam member coupled to said shaft member, and a crank gear member integrally formed with said star cam member to impart rotative movement to said crank gear member and having a crank pin supported for rotation therewith, and a drive lever member having a pivotally supported first end, a slot formed therein to receive said crank pin to impart cranking movement to said drive lever member, and a second end connected to said flexible rod member whereby reciprocal sliding movement is imparted to said toy member when said shaft member is rotated.

* * * * *